US005139086A

United States Patent [19]

Griffith, Sr.

[11] Patent Number: 5,139,086

[45] Date of Patent: Aug. 18, 1992

[54] DOUBLE ACTING ACCELERATOR JAR

[75] Inventor: Jerry M. Griffith, Sr., Scott, La.

[73] Assignee: Grifco, Inc., Scott, La.

[21] Appl. No.: 541,046

[22] Filed: Jun. 19, 1990

[51] Int. Cl.[5] ..... E21B 31/107

[52] U.S. Cl. ..... 166/178; 175/299

[58] Field of Search ..... 166/178; 175/299, 302

[56] References Cited

U.S. PATENT DOCUMENTS

| | | | |
|---|---|---|---|
| 4,844,157 | 7/1989 | Taylor | 160/178 |
| 4,846,273 | 7/1989 | Anderson et al. | 166/178 |
| 4,865,125 | 9/1989 | De Cuir | 166/178 |

*Primary Examiner*—William P. Neuder
*Attorney, Agent, or Firm*—Joseph L. Lemoine, Jr.

[57] ABSTRACT

A combined accelerator, for accumulating energy, and jar, for sudden release of accumulated energy, for delivering up or down jarring impacts to objects stuck downhole in a wellbore, includes upper and lower tubular members which are telescopically connected within an integral outer tubular housing. The upper tubular member is connected to a pipe or tubing string inserted into the wellbore and cooperates with the outer tubular housing through mechanical spring means so as to accumulate a selected amount of energy to be released as a jarring impact. The lower tubular member is connected to the stuck object and cooperates with the outer housing through spring biased, tapered latch bars, so as to provide a sudden energy releasing means. A threaded adjusting bushing is provided within the outer housing so as to allow selection of a desired amount of spring bias, imposed on the latch bars, thereby providing a convenient field means for controlling the amount of jarring impact imparted to the stuck object.

3 Claims, 5 Drawing Sheets

FIG. 8A
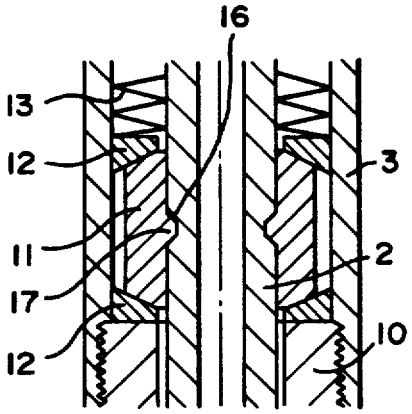
FIG. 8B
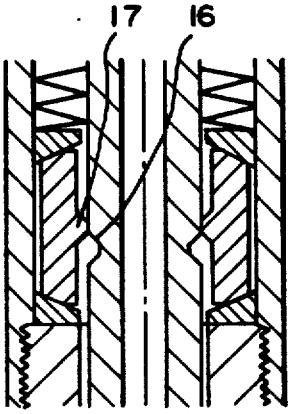
FIG. 8C
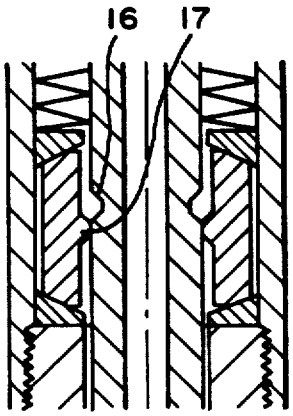
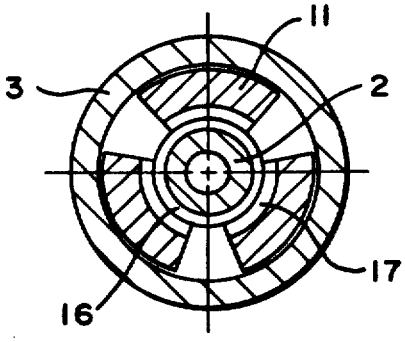
FIG. 8D

DOUBLE ACTING ACCELERATOR JAR

FIELD OF INVENTION

The present invention relates generally to apparatus utilized within a wellbore to free pipe or tools stuck downhole. More specifically, the present invention relates to downhole apparatus intended to deliver sharp, axial jarring forces to the stuck objects, thereby facilitating freeing of the stuck objects. With additional specificity, the present invention relates to a combined accelerator and jar assembly, having an operating stroke between an "up" impact position and a set position, and, between a "down" impact position and said set position. With more specificity the invention relates to an accelerator which accumulates energy in response to axial displacement of a work string, which integrally cooperates with a jar to suddenly release a selected amount of accumulated energy, and deliver said energy as a sharp impact to the stuck object. With additional specificity the invention relates to a combined up and down accelerator and jar assembly, contained within an integral, movable outer housing, which also provides a convenient field adjustable means for selecting the amount of impact force to be delivered to the stuck object.

BACKGROUND OF THE INVENTION

During the drilling and completion of wellbores, objects such as drill pipe, collars, downhole tools and other apparatus sometimes becomes stuck due to differential sticking, key seating, hole sloughing and other conditions. In such situations the stuck object sometimes cannot be freed by application of ordinary tensile or compressive forces from the surface, but may be freed by downhole delivery of sharp jarring forces.

Apparatus for delivering jarring forces ar typically known as jars. Jars generally include an outer housing which is attached to the stuck object, and, a tubular member telescopically connected therein which is attached to pipe, coiled tubing or wire from the surface. Typically contained within the jar is a force responsive latch means, which maintains the jar in a "set" position until a preselected axial force is exceeded, at which point the latch mechanism"releases", allowing the jar to "stroke" and deliver a jarring impact to the stuck object. Examples of such jars are shown in Buck U.S. Pat. No. 4,889,198; De Cuir U.S. Pat. No. 4,865,125; Buck U.S. Pat. No. 4,688,649; Clark U.S. Pat. No. 4,376,468; Taylor U.S. Pat. No. 4,333,542. Such jars may be utilized alone, or in cooperation with downhole means to store, or accumulate, an increased amount of energy to be delivered to the stuck object.

Downhole apparatus for accumulating an increased amount of energy to be released as a jarring impact are typically referred to as accelerators, but are variously referred to as jar boosters, accumulators or intensifiers. The primary function of such devices, which are typically inserted into the work string near the jars, is to store an increased amount of energy in response to upward or downward displacement of the work string, for enhancement of the jarring impact on the stuck object when the jar strokes. Examples of such devices are shown in Anderson, et al U.S. Pat. No. 4,846,273 and Taylor U.S. Pat. No. 4,844,157.

Not previously known is a combined accelerator and jar mechanism within an integral outer housing, which utilizes the mass entire outer housing as a movable hammer. Also not previously known is a combined accelerator and jar, within an integral housing, which is capable of imparting both "up" and/or "down" impacts, in any desired number and/or sequence of impacts, in either direction. Also not previously known is a jar utilizing rigid latch bars which, through tapered shoulders, cooperate with a spring biasing means whose compression may be adjusted, so as to allow selection of the amount of jarring impact delivered to the stuck object.

SUMMARY OF THE INVENTION

The invention disclosed herein is a combined accelerator and jar mechanism, contained within an integral outer housing. Telescopically connected within the outer housing is an upper tubular member, sometimes referred to as the "operating mandrel", and a lower tubular member, sometimes referred to as the "jarring mandrel". The operating mandrel is connected to a "work string" (pipe, coiled tubing or wire) which extends to the surface. The operating mandrel cooperates with the outer housing through an upper or lower accumulator spring means, such that when the operating mandrel is axially displaced, whether upward or downward relative to a neutral position of the outer housing, a respective spring stores or accumulates energy therein.

Upon axial displacement of the operating mandrel, movement of the outer housing is initially precluded by jar means contained in the lower half of the outer housing, until a selected axial force is exceeded. When said selected axial force is exceeded, the entire outer housing is released to move freely in response to force stored within said accumulator spring means, until the outer housing contacts a striker flange of the jarring mandrel. As the jarring mandrel is connected to the stuck object, a jarring impact is thereby transmitted to the stuck object.

As both the accelerator portion of the apparatus (generally corresponding adjacent to operating mandrel) and the jarring portion of the apparatus (generally corresponding to that portion adjacent to the jarring mandrel) are capable of either "up" or "down" strokes, from a medial neutral position, the combined apparatus may be operated so as to deliver any desired number and sequence of strokes, in either direction.

Also disclosed herein is an improved jar latching mechanism, which embodies the attributes of simplicity, ease of manufacture and maintenance, repeatability, durability and is also conveniently field adjustable to a desired latching force (thereby controlling the amount of impact delivered to the stuck object). The latching mechanism includes a set of riqid latch bars containing a generally V shaped lug, which is matingly engageable with a bevelled groove on the jarring mandrel. The upper and lower edges of said latch bars are tapered towards the jarring mandrel and cooperate with an axially disposed latch bar biasing spring, so as to establish the amount of radially inward force holding the latch bar lug into engagement with the bevelled groove of the jarring mandrel. The greater force which the latch bar biasing spring exerts on the tapered edges of the latch bars, the more radially inward force is exerted by the latch bars on the jarring mandrel, and therefore a greater axial force is required to unseat the latching mechanism to cause a jarring impact to be delivered to the stuck object. A threaded adjusting bushing cooperates with the outer housing and the upper end of the latch bar biasing spring, in order to provide a convenient field means for selecting a desired amount of jarring impact to be delivered to the stuck object.

BRIEF DESCRIPTION OF THE DRAWINGS

FIG. 7.B. is an axial schematical detail view of the threaded adjusting bushing, adjusted somewhat downwardly (for more compression of the latch biasing spring).

FIG. 8.A. is an axial schematical detail view of the latching mechanism of the present invention with the latch bars in a neutral position (the V shaped lugs of the latch bar engaged with the bevelled groove of the jarring mandrel).

FIG. 8.B. is an axial schematical detail view of the latching mechanism after being released by a sufficient upward force.

FIG. 8.C. is an axial schematical detail view of the latching mechanism after being released by a sufficient downward force.

FIG. 8.D. is a radial schematical detail view of present invention taken along a line through the latch bars.

FIG. 9.B. is a axial schematical detail view showing placement of a restraining bushing, when desired, to prevent "up" impacts.

DESCRIPTION OF THE PREFERRED EMBODIMENT

Figure 1:
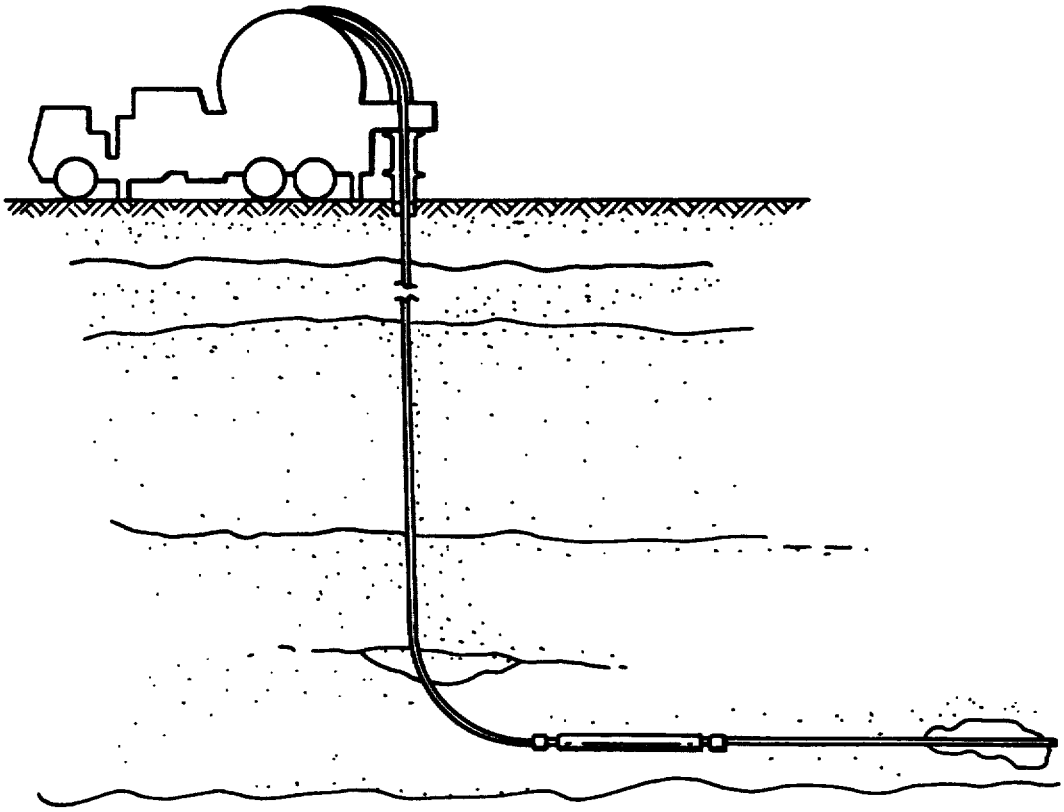
FIG. 1 is a generalized schematical view of the apparatus being operated by a coiled tubing work string within a highly directional wellbore.
Figure 2:
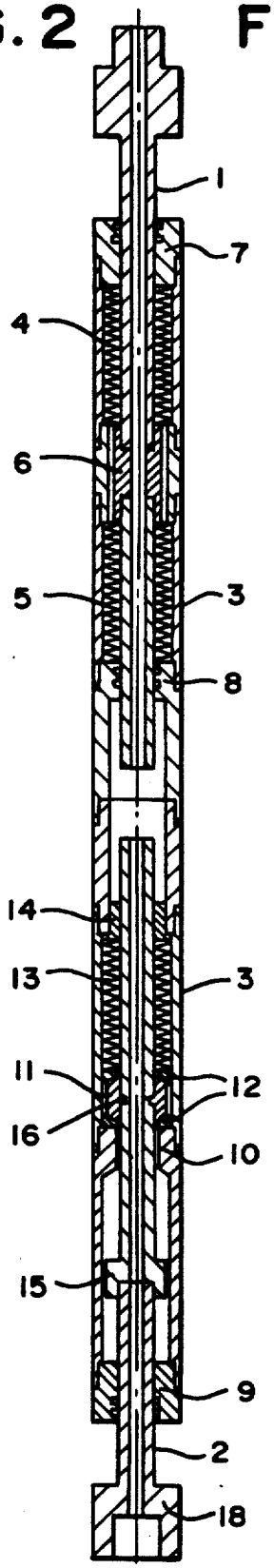
FIG. 2 is an axial schematical view of the present invention in the "set", or neutral position, without any force being applied to the operating mandrel.

Referring generally to FIG. 2, the apparatus of the present invention includes an upper tubular member, "operating mandrel" 1, and a lower tubular member, "jarring mandrel" 2, telescopically connected within an integral, tubular outer housing 3, having bushing 7 and 8. The upper part of operating mandrel 1, is connected to, and operated by, a work string (pipe, coiled tubing or wireline) extending to the surface of the wellbore. The lower part of jarring mandrel 2 is connected to, and operates on, the object, frequently called the "fish", stuck in the wellbore.

Figure 5:
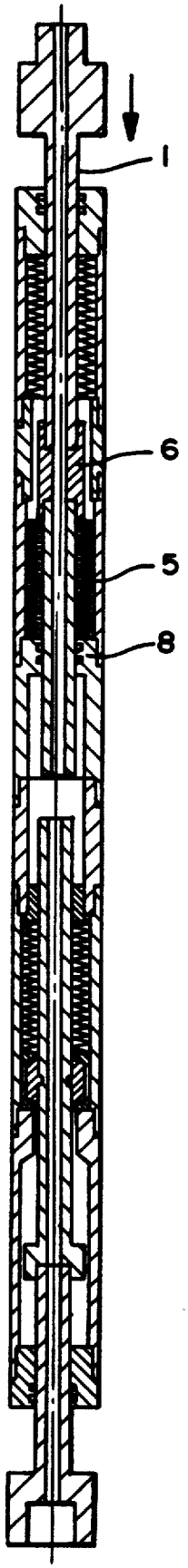
FIG. 5 is an axial schematical view of the present invention with a downward force less than that required to trigger release of the latching bars being applied to the operating mandrel.

Within outer housing 3, cooperating between compression flange 6 of operating mandrel 1 and bushing 7 and 8, are compression type springs, called "accumulator springs" 4 and 5. Therefore, if, by means of work string, operating mandrel 1 is displaced axially upward relative to outer housing 3, as is show in FIG. 3, accumulator spring 4 is forced into compression between compression flange 6, and upper bushing 7, thereby accumulating energy within spring 4, which is available for release as an upward jarring impact. Conversely if, by means of work string, operating mandrel 1 is displaced axially downward relative to outer housing 3, as is shown in FIG. 5, accumulator spring 5 is forced into compression between compression flange 6 and lower bushing 8, thereby accumulating energy within spring 5 which is available for release as a downward jarring impact. Hence the upper section, which is in general proximity with the operating mandrel, of the combined apparatus is sometimes referred to as the accelerator, or accumulator, section of the apparatus. Its general purpose is to store energy, within spring 4 or spring 5, in response to axial displacement of the operating mandrel 1 relative to outer housing 3. Upon release of outer housing 3 (by the lower, or "jar", section of the combined tool which will hereinafter be described) outer housing 3 accelerates axially in response to the accumulated spring force (in either spring 4 or 5) until outer housing 3 delivers a jarring impact.

Referring again, generally to FIG. 2, the lower portion of outer housing 3 contains jarring mandrel 2, striker bushing 9, intermediate bushing 10, latch bars 11, tapered bushing 12, latch bias spring 13 and threaded adjusting bushing 14. Jarring mandrel 2 includes striker flanges 15 and 18 and bevelled groove 16.

Figure 7A:
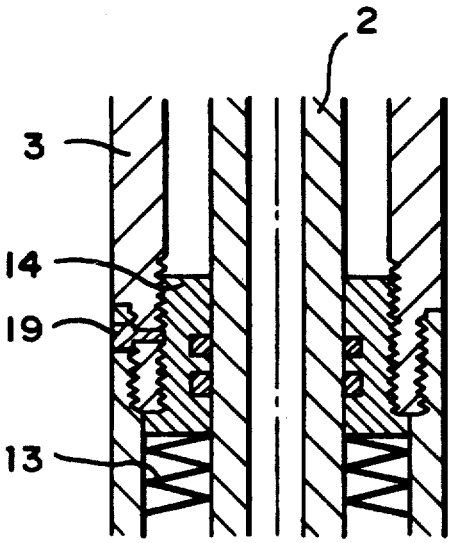
FIG. 7.A. is an axial schematical detail view of the threaded adjusting bushing, in its uppermost position (least amount of compression of the latch biasing spring).
Figure 7B:
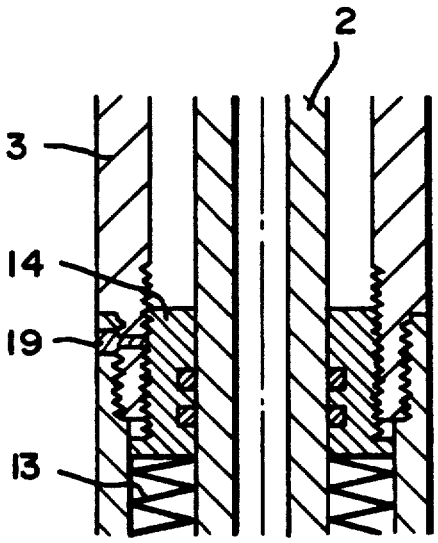

Referring particularly to FIG. 8.A., 8.B., 8.C. and 8.D. for detail, latch bars 11 each include a generally V shaped, projecting, latch lug 17, which is matingly engageable with bevelled groove 16 of jarring mandrel 2. Latch lug 17 is urged radially inward by virtue of tapered bushing 12 acting on correspondingly tapered shoulders of latch bars 11. The amount of radially inward force acting on latch bars 11 is determined by the amount of compression force exerted by latch bias spring 13 on tapered bushing 12. Referring particularly to FIG. 7.A. and 7.B. the amount of compression force exerted by latch bias spring 13 on tapered bushing 12 is determined by the position of threaded adjustment bushing 14. As threaded adjustment bushing 14 is positioned more downwardly, latch bias spring 13 is forced intro greater compression, which results in more axial force on tapered bushing 12, which in turn causes latch bar 11 to be thrust radially inward with greater force against jarring mandrel 2. Once threaded adjustment bushing 14 is adjusted to a desired position, it is secured in place by means of set screw 19. As latch bar 11 is driven against jarring mandrel 2 with greater force, latch lug 17 is more difficult to disengage from bevelled groove 16, and a greater axial force must be applied to outer housing 3 to "unseat" or release latch lug 17. Conversely the lesser the amount of spring bias which is applied to latch bar 11, the easier it is to release outer housing 3.

Figure 3:
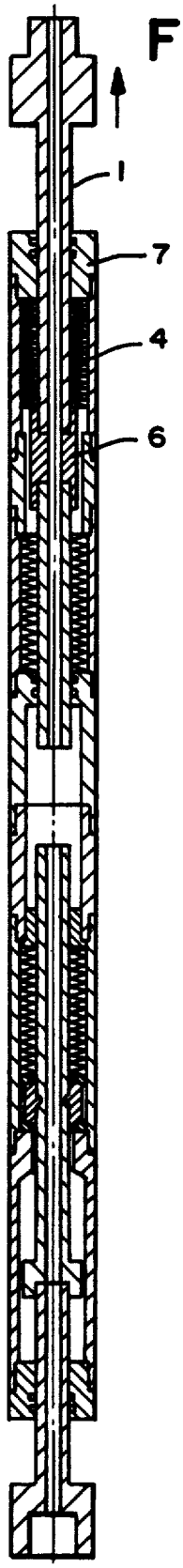
FIG. 3 is an axial schematical view of the present invention with an upward force less than that required to trigger release of the latching bars being applied to the operating mandrel.
Figure 4:
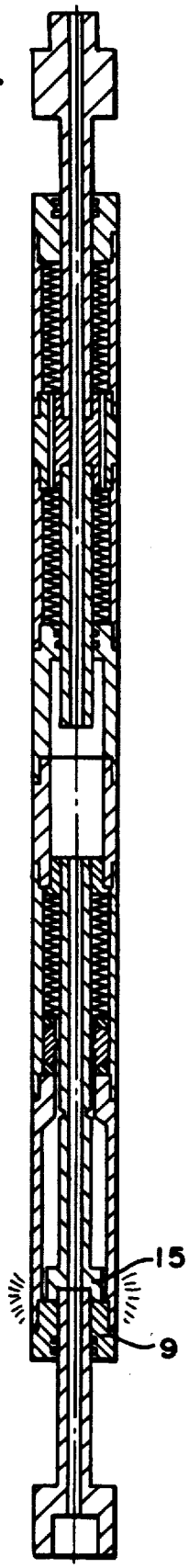
FIG. 4 is an axial schematical view of the present invention at the moment of delivering an upward jarring impact.
Figure 6:
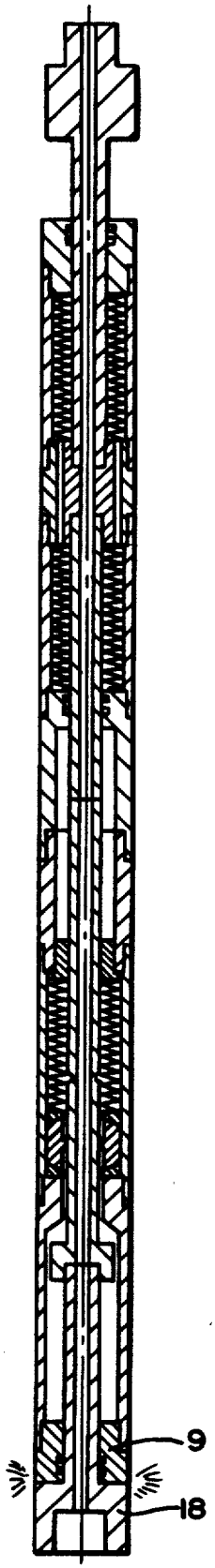
FIG. 6 is an axial schematical view of the present invention at the moment of delivering a downward jarring impact.

When the outer housing 3 is released from latching engagement with jarring mandrel 2, outer housing 3 becomes free to move, as an integral unit, in response to the spring forces accumulated in either spring 4 (for upward forces) or spring 5 (for downward forces), until striker bushing 9 of outer housing 3 contacts either striker flange 15 (for upward impacts) or striker flange 18 (for downward impacts). FIG. 3 schematically illustrates the position of the various components under tensile (upward) forces from the surface, before the latching mechanism has released outer housing 3. FIG. 4 schematically illustrates the position of various components moments after FIG. 3, that is, after the latching mechanism has released outer housing 3, and outer housing 3 has moved upward until striker bushing 9 has contacted striker flange 15, thereby delivering a jarring impact to jarring mandrel 2 (which is connected to the stuck object). Conversely FIG. 5 shows the present invention under compressive forces from the surface, moments before release of outer housing 3, and, FIG. 6 illustrates the apparatus at the moment of delivering a downward jarring impact (striker bushing 9 delivering a blow to striker flange 18).

Figure 9A:
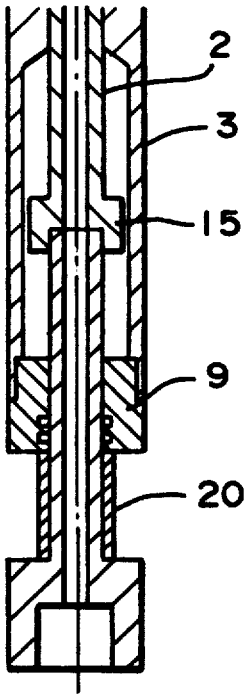
FIG. 9.A. is an axial schematical detail view showing placement of a restraining bushing, when desired, to prevent "down" impacts.
Figure 9B:
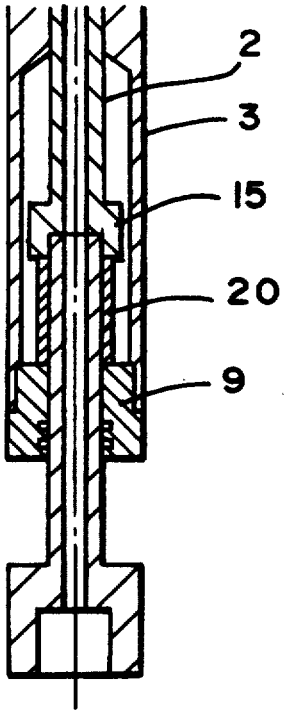

As can easily be seen by the aforesaid description of the various operating components, the present invention functions as an integral unit, first accumulating then releasing a selected amount of energy, which is delivered to the stuck object as a sharp jarring impact, by means of movement of a relatively massive, integral, outer housing. From the surface the present invention can be operated so as to deliver only "up" jars, only "down" jars, both, or any combination, number and sequence of up and down blows. For instance, to deliver an up impact to the stuck object, the operator increases upward pull on the work string until he receives an indication that the apparatus has stroked (usually a sharp drop in hydraulic pressure used to control tension of the work string). To reset the apparatus to neutral the operator simply lowers the work string until he receives an indication that the jar has reset to neutral (usually a smaller momentary drop in hydraulic pressure followed by an increasing pressure build-up). Once it has determined that the latch mechanism is reset the operator may choose another up impact, or try a down impact, whichever in the operator's judgement is appropriate under the exigent circumstances. In this fashion any number of up or down impacts may be followed by any other sequence of impacts, as desired In some circumstances it may be possible that an operator would wish to positively preclude the possibility of any strokes occurring in a certain direction. In such circumstances restraining bushing 20 may be installed in the position shown in FIG. 9.A. to preclude any down impacts, or in the position shown in FIG.9.B. to preclude any up impacts.

The foregoing description is illustrative and exemplary of the preferred embodiment of the present invention, and should not be interpreted in a limiting sense.

What is claimed is:

1. A combined accelerator and jar apparatus, for use in combination with a work-string in a wellbore, for imparting any number of either up, down or any combination of both up and down jarring blows to an object stuck in the wellbore, for the purpose of freeing the stuck object, comprising:

a) a movable hammer means comprising an elongate tubular outer housing containing a plurality of inwardly projecting bushing, wherein said outer housing has an upper chamber for containing a bi-directional accelerator means and a lower chamber for containing a bi-directional trigger and reset means, b) a bi-directional accelerator means comprising:

i) an upper mandrel telescopically disposed within the upper chamber of the outer housing, wherein said upper mandrel has a radially extending flange which, in combination with the outer housing, forms two spring chambers within the upper chamber of the outer housing, ii) substantially identical frusto-conical disc springs and flat spacers arranged in a series array and disposed within each of said spring chambers c) a bi-directional trigger and reset means comprising:

i) a plurality of latch bars disposed within the lower chamber of the outer housing, wherein said latch bars have generally V-shaped lugs projecting radially inward and have shoulders tapering radially outward, ii) tapering bushing, having shoulders tapering radially inward, disposed axially to the latch bars, iii) a compression spring means disposed adjacent to at least one of said tapering bushing, iv) a lower mandrel telescopically disposed within the lower chamber of the outer housing, wherein said lower mandrel has a generally V-shaped groove for matingly engaging the projecting lugs of the latch bars and which has a hammer means comprised of at least one radially extending flange, d) means for connecting the upper end of the upper mandrel to the wellbore work string, e) means for connecting the lower end of the lower mandrel to the object stuck within the wellbore.

2. The apparatus of claim 1 further comprising:

f) an axially adjustable bushing which bears on an end of the compression spring means which is opposite to the tapering bushings of the bi-directional trigger and reset means.

3. The apparatus of claim 1 wherein the compression spring means is comprised of a plurality of frusto-conical disc springs and flat spacers arranged in an array.

* * * * *